US011627420B2

(12) United States Patent
Ledingham

(10) Patent No.: US 11,627,420 B2
(45) Date of Patent: Apr. 11, 2023

(54) LOOP ANTENNA FOR HEARING AID

(71) Applicant: Bose Corporation, Framingham, MA (US)

(72) Inventor: Stephen Ledingham, Waltham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 17/320,843

(22) Filed: May 14, 2021

(65) Prior Publication Data

US 2022/0369049 A1 Nov. 17, 2022

(51) Int. Cl.

| | |
|---|---|
| ***H04R 25/00*** | (2006.01) |
| ***H01Q 1/38*** | (2006.01) |
| ***H01Q 1/27*** | (2006.01) |
| ***H01Q 7/00*** | (2006.01) |

(52) U.S. Cl.

CPC ..... *H04R 25/554* (2013.01); *H01Q 1/273* (2013.01); *H01Q 1/38* (2013.01); *H01Q 7/00* (2013.01); *H04R 25/602* (2013.01); *H04R 25/604* (2013.01); *H04R 25/609* (2019.05); *H04R 2225/021* (2013.01); *H04R 2225/025* (2013.01); *H04R 2225/51* (2013.01)

(58) Field of Classification Search

CPC .. H04R 25/554; H04R 25/602; H04R 25/604; H04R 25/609; H04R 2225/021; H04R 2225/025; H04R 2225/51; H01Q 1/273; H01Q 1/38; H01Q 7/00

See application file for complete search history.

(56) References Cited

U.S. PATENT DOCUMENTS 5,198,826 A * 3/1993 Ito ..... H01Q 7/00 343/726
7,446,729 B2 * 11/2008 Maruyama ..... G06K 19/07749 343/742

(Continued)

FOREIGN PATENT DOCUMENTS

CN 106463831 A * 2/2017 ..... H01Q 1/24
EP 2824942 A1 1/2015

(Continued)

*Primary Examiner* — Angelica M McKinney

(74) *Attorney, Agent, or Firm* — Bond, Schoeneck & King, PLLC

(57) ABSTRACT

A hearing aid including a hearing aid antenna assembly, a transceiver, and an acoustic transducer is provided. The hearing aid assembly includes a resonant loop antenna, a coupling mechanism such as a primary loop, and an electrically conductive assembly. The resonant loop antenna forms an aperture that is arranged to be substantially parallel to a head of the wearer when the hearing aid is worn. The coupling mechanism is configured to transfer RF energy between the transceiver and the resonant loop antenna. The resonant loop antenna excites the electrically conductive assembly. The electrically conductive assembly includes a battery shield. The resonant loop antenna, the coupling mechanism, and/or the electrically conductive assembly are formed in one or more conductive layers of FPCB. The resonant loop antenna includes a course tuning capacitor in series with a fine tuning capacitor. The primary loop includes a resonating capacitor.

24 Claims, 5 Drawing Sheets

(56) References Cited

U.S. PATENT DOCUMENTS

| | | | | |
|---|---|---|---|---|
| 8,288,893 | B2 * | 10/2012 | Cook | G06K 7/10178 307/98 |
| 8,300,863 | B2 | 10/2012 | Knudsen et al. | |
| 8,565,457 | B2 * | 10/2013 | Polinske | H04R 25/602 381/322 |
| 8,699,733 | B2 | 4/2014 | Polinske et al. | |
| 8,867,765 | B2 | 10/2014 | Solum | |
| 8,934,984 | B2 | 1/2015 | Meskens et al. | |
| 9,237,404 | B2 | 1/2016 | Ozden et al. | |
| 9,295,848 | B2 | 3/2016 | Meskens | |
| 9,397,399 | B2 * | 7/2016 | Pajona | H01Q 1/243 |
| 9,446,233 | B2 | 9/2016 | Meskens et al. | |
| 9,936,312 | B2 | 4/2018 | Meskens et al. | |
| 10,021,495 | B2 | 7/2018 | Vonlanthen et al. | |
| 10,219,084 | B2 | 2/2019 | Meskens et al. | |
| 10,804,599 | B2 * | 10/2020 | Abadia | H04R 25/552 |
| 2008/0304686 | A1 * | 12/2008 | Meskens | H04R 25/554 381/330 |
| 2014/0321685 | A1 * | 10/2014 | Rabel | H04R 25/554 29/600 |
| 2017/0064466 | A1 * | 3/2017 | Pooladian | H04R 25/60 |
| 2017/0064467 | A1 * | 3/2017 | Fischer | H01Q 1/273 |
| 2019/0116431 | A1 * | 4/2019 | Hesselballe | H01Q 7/00 |

FOREIGN PATENT DOCUMENTS

| | | | | |
|---|---|---|---|---|
| EP | 2871861 | A1 * | 5/2015 | H01Q 1/273 |
| EP | 3038382 | B1 * | 2/2020 | H01Q 1/273 |

* cited by examiner

LOOP ANTENNA FOR HEARING AID

BACKGROUND

This disclosure is generally directed to a loop antenna for use in a behind-the-ear wearable audio device, such as a hearing aid.

SUMMARY

All examples and features mentioned below can be combined in any technically possible way.

Generally, in an aspect, a hearing aid antenna assembly is provided. The hearing aid antenna assembly includes a resonant loop antenna. The resonant loop antenna forms an aperture that is arranged to be substantially parallel to a head of the wearer when the hearing aid antenna assembly is worn. According to an example, the aperture includes one or more open ends facing away from a human body of the wearer.

The hearing aid assembly further includes a coupling mechanism. The coupling mechanism is configured to transfer RF energy between a transceiver and the resonant loop antenna. According to an example, the coupling mechanism includes a primary loop. The primary loop can be smaller than the resonant loop antenna. According to an example, the primary loop includes a resonating capacitor.

The hearing aid assembly further includes an electrically conductive assembly. The resonant loop antenna excites the electrically conductive assembly. According to an example, the electrically conductive assembly includes a battery shield.

According to an example, a radiating assembly formed by the resonant loop antenna, the coupling mechanism, and the electrically conductive assembly has an operating frequency within a 2.4 GHz ISM band.

According to an example, the resonant loop antenna includes a first tuning capacitor. The first tuning capacitor can be positioned within the aperture of the resonant loop antenna. The first tuning capacitor can be a course tuning capacitor. The resonant loop antenna can further include a fine tuning capacitor. The fine tuning capacitor can be arranged in series with the course tuning capacitor.

According to an example, the resonant loop antenna, the coupling mechanism, and/or the electrically conductive assembly are formed in one or more conductive layers of a printed circuit board (PCB). The PCB can include a flexible printed circuit board (FPCB).

According to an example, a first end of the resonant loop antenna can be electrically coupled to earth and a second end of the resonant loop antenna can be electrically coupled to a single ended RF feed via a matching circuit.

According to an example, a first end of the primary loop can be electrically coupled to the resonant loop antenna and a second end of the primary loop can be electrically coupled to a single ended RF feed via a matching circuit.

According to an example, the primary loop can be electrically coupled to a differential RF feed via a differential matching circuit.

Generally, in another aspect, a hearing aid is provided. The hearing aid includes the hearing aid antenna assembly as described above. According to an example, the hearing aid antenna assembly is supported in a housing configured to be positioned behind an ear of a wearer. The hearing aid antenna assembly can be oriented such that the aperture of the hearing aid antenna assembly faces parallel relative to a head of the wearer.

The hearing aid includes a transceiver. The transceiver is electrically coupled to the hearing aid antenna assembly. The transceiver can be a Bluetooth transceiver.

According to an example, the hearing aid antenna assembly is electrically coupled to the transceiver via a matching network. The matching network can be a broadband matching network.

According to an example, the resonant loop antenna has a dipole radiation pattern in free space. The aperture of the resonant loop antenna can be arranged substantially along the axis of the dipole.

According to an example, the transceiver is configured to generate an audio signal. The audio signal is based on audio data received by the hearing aid antenna assembly. The hearing aid can further include an acoustic transducer. The acoustic transducer can be configured to generate audio based on the audio signal. The acoustic transducer can be configured to be positioned within an ear canal of a wearer. The audio data can be transmitted by a smartphone.

In various implementations, a processor or controller can be associated with one or more storage media (generically referred to herein as "memory," e.g., volatile and non-volatile computer memory such as ROM, RAM, PROM, EPROM, and EEPROM, floppy disks, compact disks, optical disks, magnetic tape, Flash, OTP-ROM, SSD, HDD, etc.). In some implementations, the storage media can be encoded with one or more programs that, when executed on one or more processors and/or controllers, perform at least some of the functions discussed herein. Various storage media can be fixed within a processor or controller or can be transportable, such that the one or more programs stored thereon can be loaded into a processor or controller so as to implement various aspects as discussed herein. The terms "program" or "computer program" are used herein in a generic sense to refer to any type of computer code (e.g., software or microcode) that can be employed to program one or more processors or controllers.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also can appear in any disclosure incorporated by reference should be accorded a meaning most consistent with the particular concepts disclosed herein.

Other features and advantages will be apparent from the description and the claims.

DETAILED DESCRIPTION

Figure 1A:
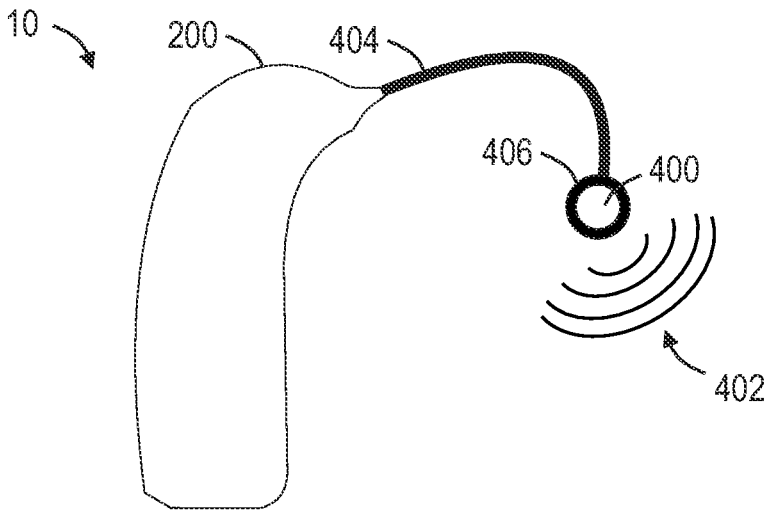
FIG. 1A depicts a hearing aid, according to an example.

Hearing aids are commonly worn behind the ear for the purposes of convenience and discretion. Modern hearing aids often wirelessly connect to a personal device, such as a smartphone. This wireless connection may require a radio frequency (RF) signal to be transmitted across the wearer's body, such as from the wearer's waist region to behind one (or both) of the wearer's ears. The quality of this transmission path is referred to as cross body performance. Signals travelling across a user's body, to behind-the-ear hearing aids, are attenuated by the lossy materials (such as tissue, fat, bone, etc.). This attenuation reduces free space antenna efficiency and cross body performance. Accordingly, there is a need for an RF antenna to overcome these issues.

A hearing aid with a resonant loop antenna is provided to overcome the aforementioned performance and efficiency issues. This resonant loop antenna is less sensitive to human body detuning, thus producing strong near field electromagnetic performance unaffected by dielectric permittivity. This loop antenna configuration provides improved efficiency over a traditional monopole antenna formed by the wire, such as a receiver-in-the-canal (MC) wire, connecting hearing aid electronic components to an acoustic transducer. The resonant loop antenna operates as an electrically-short dipole. In free space the antenna has a dipole radiation pattern.

The resonant loop antenna is arranged in a hearing aid antenna assembly within a housing configured to be positioned behind the ear of the wearer. The hearing aid antenna assembly includes a coupling mechanism to transfer RF energy between transceiver and the resonant loop antenna. The hearing aid assembly also includes an electrically conductive assembly excited by the resonant loop antenna. In some example, the coupling mechanism includes a primary loop magnetically coupled to the resonant loop antenna to form a transformer configuration, to provide for maximum power transfer to and from the radiating components of the hearing aid antenna assembly.

The primary loop, the resonant loop antenna, and the electrically conductive assembly are formed from one or more conductive layers of printed circuit boards (PCBs), such as flexible printed circuit boards (FPCB). In particular, one or more FPCB members of the resonant loop antenna form an aperture. Critically, the resonant loop antenna is oriented within the housing such that the aperture faces parallel relative to the head of the user. In this orientation, the open ends of the aperture face away from the human dielectric material to minimize end loading of the aperture. This parallel orientation provides improved cross body performance relative to other loop antenna orientations. The resonant loop antenna is electrically coupled to an electrically conductive assembly configured to surround the other electrical components within the housing, such as a battery. In particular, the electrically conductive assembly includes a battery shield between the battery and the resonant loop antenna to prevent detuning.

A transceiver is coupled to the resonant loop antenna via a matching circuit and a coupling mechanism. The coupling mechanism can be implemented via an impedance transformer including a primary loop and the resonant loop antenna, or by directly feeding the resonant loop antenna via matching circuitry. The resonant loop antenna circulates current in the electrically conductive assembly to increase antenna efficiency. The transceiver operates in conjunction with a Bluetooth enabled smartphone to establish an audio path to the acoustic transducer of the hearing aid via audio processing circuitry.

Figure 4:
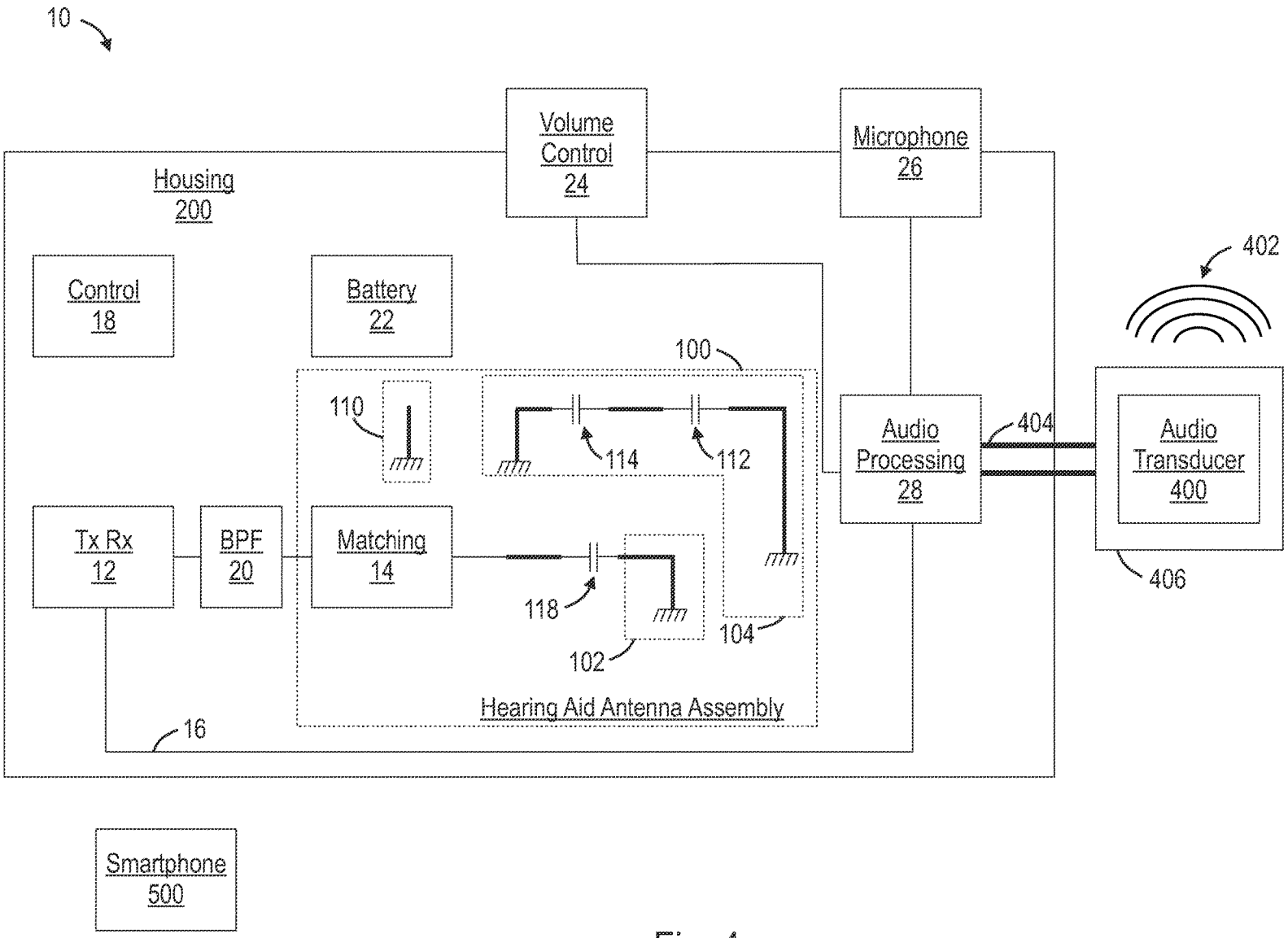
FIG. 4 is a functional block diagram of a hearing aid with a hearing aid antenna assembly, according to an example.

FIG. 1A illustrates an example of a hearing aid 10. The hearing aid 10 includes a housing 200 to be positioned behind the ear 302 of the wearer 300. As shown in FIG. 4, the housing 200 encapsulates most of the functional components of the hearing aid 10, including a hearing aid antenna assembly 100, a transceiver 12, a battery 22, a microphone 26, control circuitry 18, a volume controller 24, audio processing circuitry 28, and other components. The hearing aid 10 further includes an earpiece 406 with an acoustic transducer 400. The acoustic transducer 400 connects to the audio processing circuitry 28 internal to the housing 200 via a wire 404, such as a receiver-in-the-ear (RIC) wire. The acoustic transducer 400 generates audio 402 to be heard by the wearer 300 based on signals received from the audio processing circuitry 28. The audio 402 can be amplified environmental sound captured by the microphone 26, or audio wirelessly transmitted to the hearing aid 10 via a smartphone 500 or similar device, or a mix of both.

Figure 1B:
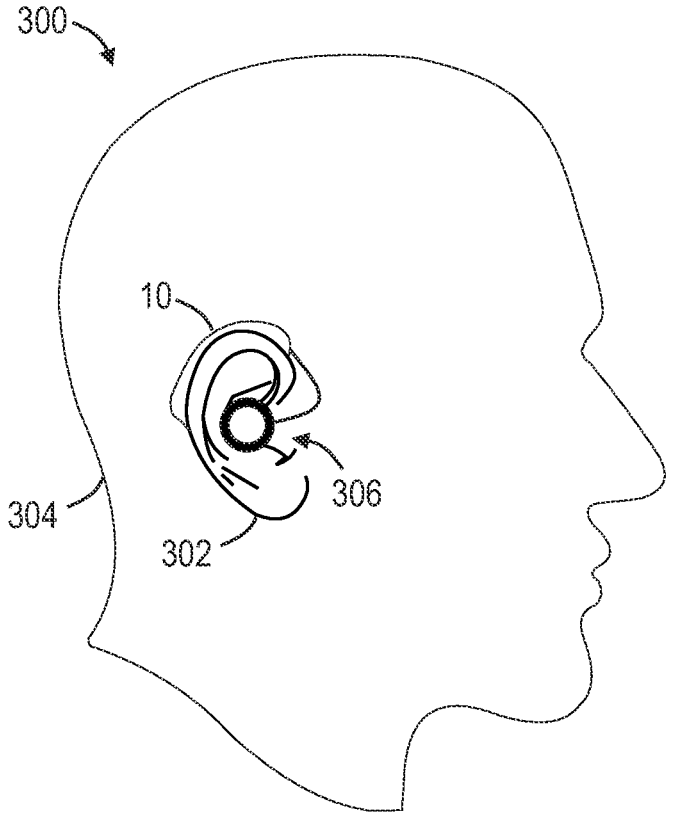
FIG. 1B depicts a hearing aid positioned behind the ear of a wearer, according to an example.

FIG. 1B further shows another example of the hearing aid 10 worn behind the ear 302 of the wearer 300. As described above, the tissue, fat, and bone of the wearer's head 304 and ear 302 attenuate RF signals transmitted to or received by the hearing aid 10. This attenuation is particularly troublesome when the hearing aid 10 is communicating with a smartphone 500 or other device worn by the wearer 300 (such as another hearing aid) requiring the RF radiation to travel across the wearer's 300 body while the wearer 300 is outdoors. Indoors, the RF signals may reflect off interior walls or other objects to form alternative transmission paths from the smartphone 500 to the hearing aid 10. Such alternative transmission paths are unavailable outdoors, limiting the hearing aid 10 to RF radiation travelling across the body of the wearer 300.

FIG. 1B shows the acoustic transducer 400 positioned in the ear canal 306 of the wearer 300. In other examples, the earpiece 406 and the acoustic transducer 400 may be positioned in other parts of the ear 302, such as in an open speaker arrangement. Depending on the application, the earpiece 400 may or may not seal the ear canal 306 of the wearer 300.

Figure 2:
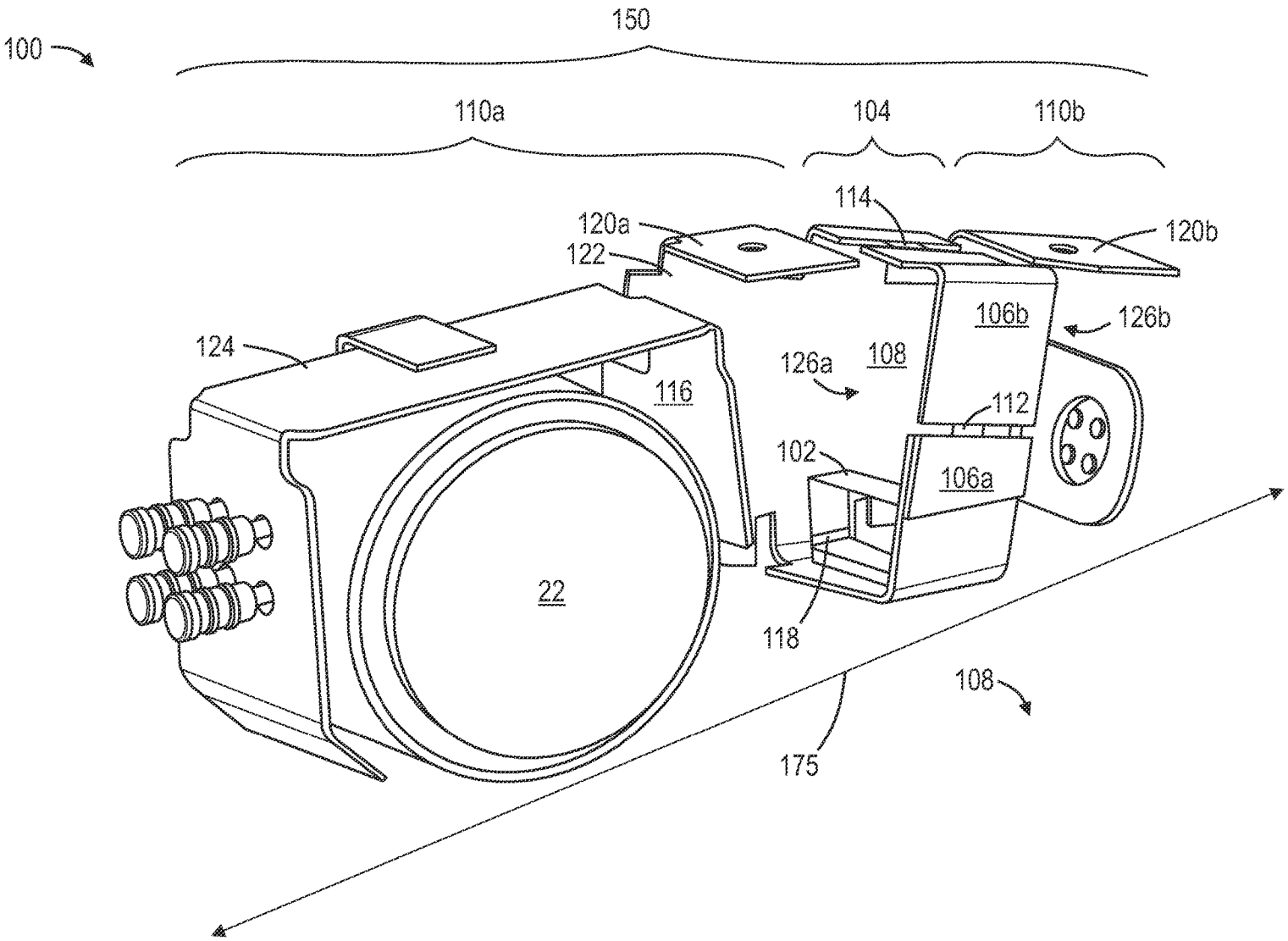
FIG. 2 depicts a hearing aid antenna assembly, according to an example.
Figure 3:
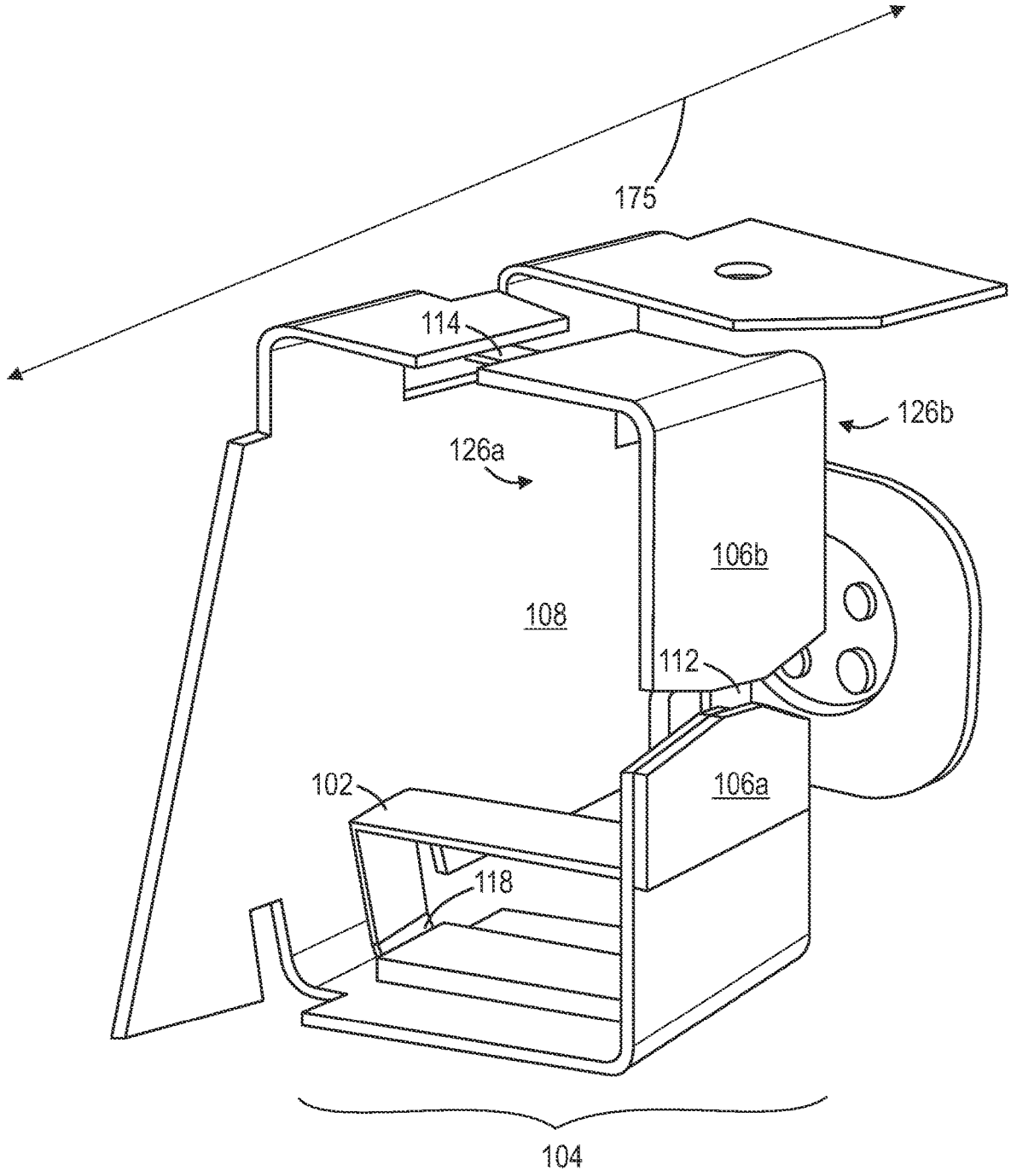
FIG. 3 depicts a primary loop and a resonant loop antenna of the hearing aid antenna assembly, according to an example.

FIG. 2 shows an example of a hearing aid antenna assembly 100. The hearing aid antenna assembly 100 includes a radiating assembly 150. The radiating assembly 150 includes a resonant loop antenna 104, a electrically conductive assembly 110, and coupling mechanism, such as a primary loop 102. In FIGS. 2 and 3, the coupling mechanism is a primary loop 102. The radiating assembly 150 generates (in transmit mode) or captures (in receive mode) RF radiation. While the resonant loop antenna 104 may be configured to transmit and/or receive radiation with a device such as a smartphone 500 in certain circumstances, the electrically conductive assembly 110 increases the overall area in which the transmitted or received current can flow, thereby increasing the radiation resistance of the entire radiating assembly 150. Increasing the area of current flow enhances the radiation efficiency of the assembly 150 as a whole to provide improved cross body performance.

In a preferred embodiment, the primary loop 102, the resonant loop antenna 104, and the electrically conductive assembly 110 are formed from FPCB with an inner or outer conductive earth layer, such as copper or gold. The resonant loop antenna 104 includes one or more members 106*a*, 106*b* forming an aperture 108. The resonant loop antenna 104 is oriented within the housing 200 such that the aperture 108 faces parallel relative to the head 304 of the wearer 300. As an illustrative example, when the aperture 108 is properly oriented, an object can pass through the aperture 108 without intersecting the wearer's head 304 or ear 302. In this orientation, the two open ends 126*a*, 126*b* of the aperture 108 face away from the human dielectric material to minimize end loading of the aperture 108. This parallel orientation provides improved cross body performance relative to other loop antenna orientations.

As shown in FIG. 3, the primary loop 102 is positioned near the resonant loop antenna 104 such that they are magnetically coupled, thus forming a transformer. The transformer formed by the primary loop 102 and the resonant loop antenna 104 provides for maximum power transfer to the electrically conductive assembly 110. Maximum power transfer is achieved by impedance matching the combined impedance of the electrically conductive assembly 110, the resonant loop antenna 104, and the head 304 and/or ear 302 of the wearer 300 to the input to/output of the hearing aid antenna assembly 200. In some configurations, this input/output can be an impedance matching network 14 electrically coupled to a transceiver 12. In further configurations, the input/output can be the transceiver 12 electrically coupled to the hearing aid antenna assembly 100 via a microstrip trace. For example, the transformer formed by the primary loop 102 and the resonant loop antenna 104 may match a 50 ohm input impedance of the matching network 14 to the combined loaded impedance (perhaps on the order of 200 ohms) of the resonant loop antenna 104, the electrically conductive assembly 110, and the wearer 300. This impedance matching corresponds to the variance in capacitance, inductance, and mutual inductance between the primary loop 102 and the resonant loop antenna 104. This inductance corresponds to the physical dimensions of the loops 102, 104. The capacitance corresponds to the course tuning capacitor 112 and the fine tuning capacitor 114 of the resonant loop antenna 104, and the series capacitor 118 of the primary loop 102. As described below, the values of these capacitors 112, 114, 118 may be tuned to optimize impedance matching.

In the configuration of FIGS. 2 and 3, and as schematically illustrated in FIG. 4, both the primary loop 102 and the resonant loop antenna 104 are coupled to earth ground. The earth ground can be a ground plane of the FPCB. Coupling each loop 102, 104 to earth ground enables the primary loop 102 and the resonant loop antenna 104 to function as an transformer. Alternatively, other transformer configurations can be implemented. In other examples, the primary loop 102 and the resonant loop antenna 104 can be arranged to form a single-ended fed or differential feed transformer.

As shown in FIG. 3, the resonant loop antenna 104 includes a course tuning capacitor 112. The course tuning capacitor 112 allows technicians to adjust the impedance of the resonant loop antenna 104. By modifying the impedance, other properties of the radiating assembly 150 may be adjusted, such as operating frequency. For efficient installation and tuning, the course tuning capacitor 112 can be installed in a gap between members 106*a*, 106*b* of the resonant loop antenna 104 adjacent to the wearer's head 304. To prevent the human dielectric of the head 304 or ear 302 from modifying its capacitance, the course tuning capacitor 112 can be positioned inside the aperture 108 of the resonant loop antenna 104.

With further reference to FIG. 3, the resonant loop antenna 104 can also include a fine tuning capacitor 114. The fine tuning capacitor 114 allows technicians to further adjust the impedance of the resonant loop antenna 104. As shown in FIG. 3, the fine tuning capacitor 114 can be positioned in a gap of the topmost member 106*b* of the resonant loop antenna 104. The value of the fine tuning capacitor 114 can be adjusted to improve return loss. The fine tuning capacitor 114 is arranged in series with the course tuning capacitor 112. In a preferred embodiment, the fine tuning capacitor 114 can be modified in higher increments of capacitance than the course tuning capacitor 112. Overall, the resonant loop antenna 104 resonates based on the capacitance of the course tuning capacitor 112, the capacitance of fine tuning capacitor 114, and the inductance of the FPCB forming the members 106*a*, 106*b* of resonant loop antenna 104.

With further reference to FIG. 3, the primary loop 102 includes a series capacitor 118. The series capacitor 118 can be any appropriate type of capacitor, such as a parallel plate, multi-layer, or thin film capacitor. The series capacitor 118 is positioned in series anywhere along the path of the primary loop 102. The inductance of primary loop 102 and the capacitance of the series capacitor 118 controls the transformer impedance ratio.

As shown in FIG. 2, the resonant loop antenna 104 is electrically coupled to the electrically conductive assembly 110, such that the resonant loop antenna 104 excites the electrically conductive assembly 110 with RF energy. The electrically conductive assembly 110 includes a number of features including two horizontal tabs 120*a*, 120*b*, a back plate 122 parallel to the wearer, and a battery enclosure 124. The horizontal tabs 120*a*, 120*b* provide locations for microphone placement. The battery enclosure surrounds a battery 22 used to power the various electrical components within the housing 200. The battery enclosure includes a battery shield 116 between the battery 22 and the resonant loop antenna 104. The battery shield 116 is an FPCB member providing an electric field boundary between the battery 22 (and the wiring associated with the battery 22) and the resonant loop antenna 104. This electric field boundary prevents the resonant loop antenna 104 from being detuned by the battery 22 and its associated wiring. The electrically conductive assembly 110 improves the radiation efficiency and bandwidth of the resonant loop antenna 104.

When energized with RF current, the radiating assembly 150 acts as an electrically short dipole antenna having an axis 175 along the length of the assembly 150. In this example, the aperture 108 of the resonant loop antenna 104 is arranged substantially along the axis of the dipole. As an electrically short dipole antenna, the length of the radiating assembly 150 is less than the wavelength corresponding to its operating frequency. For example, if the hearing aid 10 is transmitting and receiving Bluetooth data with a smartphone 500, the Bluetooth data will be transmitted within the 2.4 GHz ISM frequency band. The wavelength of a 2.4 GHz signal is approximately 12.5 cm. Thus, the length of the radiating assembly 150 must be less than 12.5 cm. In practice, the radiating assembly 150 may be approximately 30-60 mm in length. In use, the resonant loop antenna generates a dipole radiation pattern in free space.

FIG. 4 is a functional block diagram of the hearing aid 10. The hearing aid 10 includes a housing 200 connected to an acoustic transducer 400 via a RIC wire 404. The housing 200 includes a hearing aid antenna assembly 100, control circuitry 18, transceiver 12, battery 22, an optional matching network 14, an optional bandpass filter 20, volume control 24, microphone 26, and audio processing circuitry 28. The hearing aid 10 can communicate bidirectionally with a smartphone 500 via the hearing aid antenna assembly 100.

The control circuitry 18 can be used to control a wide variety of the electrical components of the hearing aid 10. For example, the control circuitry 18 can be used control the settings of the transceiver 12, the power output of the battery 22, the volume levels and/or increments of the volume control 24, the mix of the output of the audio processing circuitry 28, etc.

When transmitting data to the smartphone 500, the transceiver 12 modulates an RF signal with the data. If the transceiver 12 is a Bluetooth transceiver, the information may be modulated according to a Bluetooth protocol, such as Bluetooth Classic or LE Audio.

The transceiver 12 then provides the RF signal to a hearing aid antenna assembly 100, including an optional broadband matching network 14, a coupling mechanism, such as a primary loop 102, and a resonant loop antenna 104.

In further examples, a bandpass filter 20 can be used to remove undesired spectra from the RF signal to be transmitted by the hearing aid antenna assembly 100 or the RF signal received by the hearing aid antenna assembly 100.

The primary loop 102 and the resonant loop antenna 104 form a transformer. The transformer formed by the primary loop 102 and the resonant loop antenna 104 approximately matches the impedance of the matching network 14 to the combined impedance of the resonant loop antenna 104, the electrically conductive assembly 110, and the ear 302 and/or head 304 of the wearer 300 to maximize RF power transfer. The transformer generates a secondary current through the resonant loop antenna 104. This secondary current is radiated by the resonant loop antenna 104 and the electrically conductive assembly 110, and is received by the smartphone 500 worn by the wearer 300.

When receiving information from the smartphone 500, the electrically conductive assembly 110 and the resonant loop antenna 104 generate current based on the received radiation. The transformer, formed by the resonant loop antenna 104 and the primary loop 102, generates a secondary current through the primary loop 102. This secondary current is provided to the transceiver 12 via the matching network 14. The transceiver 12 demodulates audio data from the secondary current to generate an audio signal 16. This audio signal 116 is then provided to the audio processing circuitry 28. The audio processing circuitry 28 can include a wide variety of circuitry, such as amplifier, switches, transistors, etc. to process audio signals from the transceiver 12, the microphone 26, and/or other audio sources. Once processed by the audio processing circuitry 28, the audio 402 plays for the wearer 300 via the acoustic transducer 400 of the hearing aid 10. The volume of the audio 402 can correspond to the settings of the volume control 24. The audio 402 played via the acoustic transducer 400 may further include environmental audio captured by the microphone 26. The audio data transmitted by the smartphone 500 may be mixed with the environmental audio according to additional control settings.

Figure 5A:
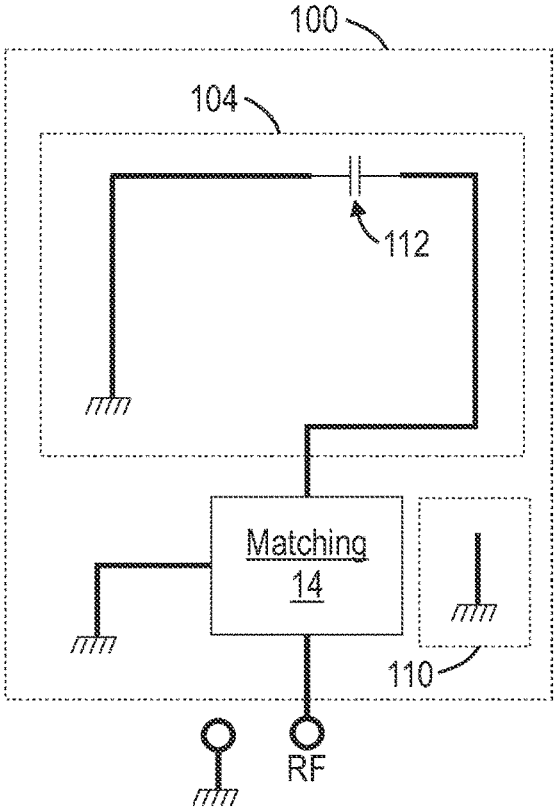
FIGS. 5A-5C are circuit schematics depicting various embodiments of hearing aid antenna assemblies.
Figure 5B:
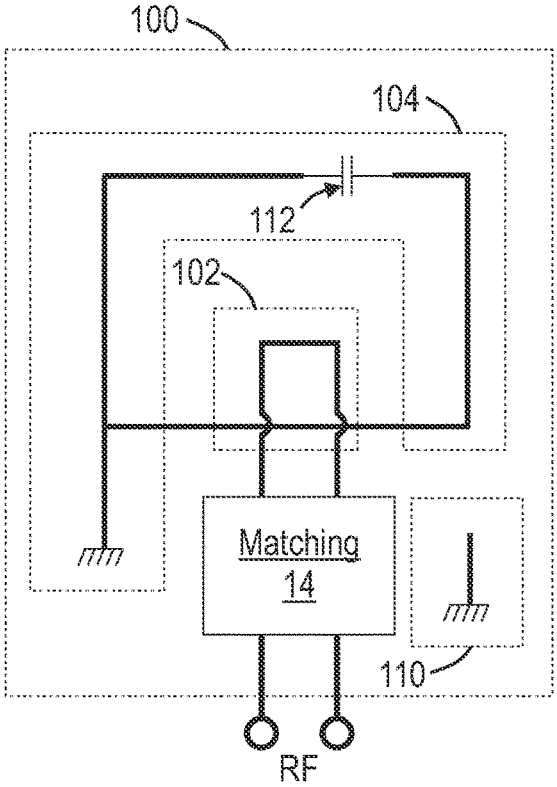
Figure 5C:
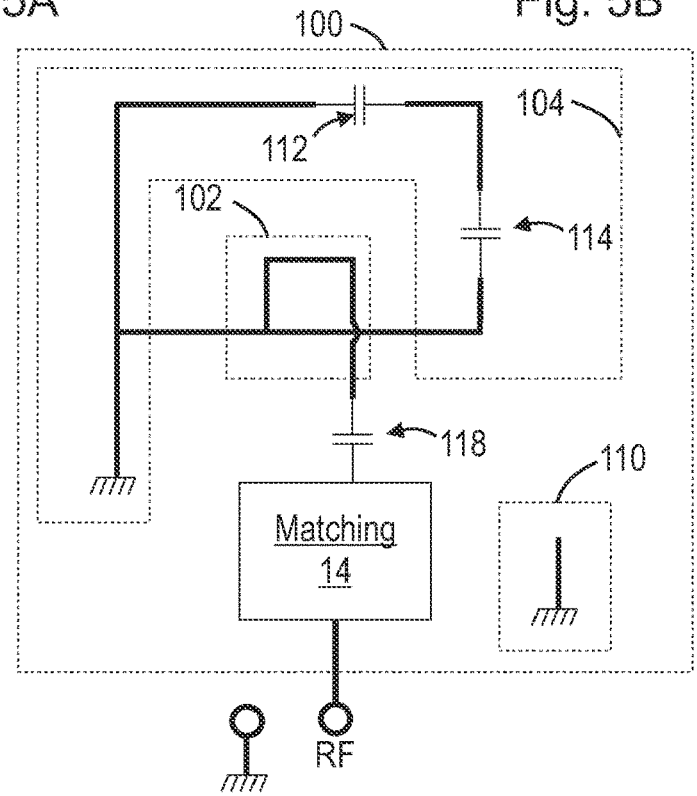

FIGS. 5A-5C are circuit schematics depicting various, non-limiting, examples of hearing aid antenna assemblies 100. FIG. 5A depicts a single-ended fed antenna configuration. In this example, the hearing aid antenna assembly 100 includes a resonant loop antenna 104 with a course tuning capacitor 112. The hearing aid antenna assembly 100 further includes an electrically conductive assembly 110 electrically coupled to the resonant loop antenna 104. The electrically conductive assembly 110 improves the radiation efficiency and bandwidth of the resonant loop antenna 104. Rather than the transformer configuration discussed previously, the resonant loop antenna 104 is electrically coupled to a single-ended RF input by a broadband matching network 14. This matching network 14 is designed to match the combined impedance of the resonant loop antenna 104, the electrically conductive assembly 110, and the head 304 and/or ear 302 of the wearer 300 to the impedance of the source of the single-ended RF input.

As an alternative to FIG. 5A, FIG. 5B depicts a differential feed antenna configuration. As with the single-ended feed example of FIG. 5A, the hearing aid antenna assembly 100 includes a resonant loop antenna 104 with a course tuning capacitor 112. However, the example of FIG. 5B includes a primary loop 102. The primary loop 102 is electrically coupled to a differential RF input via matching network 14. The primary loop 102 magnetically couples to the resonant loop antenna 104 to form a transformer configuration. Notably, and as shown in FIG. 5B, the primary loop 102 does not share current with the resonant loop antenna 104. The transformer configuration and the matching network 14 are designed to match the combined impedance of the resonant loop antenna 104, the electrically conductive assembly 110, and the head 304 and/or ear 302 of the wearer 300 to the impedance of the source of the differential RF input.

As a further alternative to FIGS. 5A and 5B, FIG. 5C depicts a single-ended fed antenna configuration. As with the single-ended feed example of FIG. 5A, the hearing aid antenna assembly 100 includes a resonant loop antenna 104 with a course tuning capacitor 112. In the example of FIG. 5C, the resonant loop antenna 104 further includes a fine tuning capacitor 114. As with the example of FIG. 5B, the example of FIG. 5C includes a primary loop 102. The primary loop 102 can includes resonating capacitor 118. The primary loop 102 is electrically coupled to a single-ended RF input via matching network 14. The primary loop 102 magnetically couples to the resonant loop antenna 104 to form a transformer configuration. Notably, the primary loop 102 and the resonant loop antenna 104 also share a current via the FPCB ground plane at the transformer tap point, thus forming an autotransformer configuration. The autotransformer configuration, the resonating capacitor 118, and the matching network 14 are designed to match the combined impedance of the resonant loop antenna 104, the electrically conductive assembly 110, and the head 304 and/or ear 302 of the wearer 300 to the impedance of the source of the single-ended RF input.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. A hearing aid antenna assembly, comprising:

a resonant loop antenna, comprising:

a course tuning capacitor; and a fine tuning capacitor arranged in series with the course tuning capacitor;

a coupling mechanism configured to transfer RF energy between a transceiver and the resonant loop antenna; and an electrically conductive assembly;

wherein the resonant loop antenna forms an aperture that is arranged to be parallel to a head of a wearer when the hearing aid antenna assembly is worn, and wherein the resonant loop antenna excites the electrically conductive assembly.

2. The hearing aid antenna assembly of claim 1, wherein the coupling mechanism comprises a primary loop.

3. The hearing aid antenna assembly of claim 2, wherein the primary loop is smaller than the resonant loop antenna.

4. The hearing aid antenna assembly of claim 2, wherein the primary loop comprises a resonating capacitor.

5. The hearing aid antenna assembly of claim 2, wherein the primary loop is electrically coupled to a differential RF feed via a differential matching circuit.

6. The hearing aid antenna assembly of claim 1, wherein a radiating assembly formed by the resonant loop antenna, the coupling mechanism, and the electrically conductive assembly has an operating frequency within a 2.4 GHz ISM band.

7. The hearing aid antenna assembly of claim 1, wherein the first tuning capacitor is positioned within the aperture of the resonant loop antenna.

8. The hearing aid antenna assembly of claim 1, wherein the resonant loop antenna, the coupling mechanism, and/or the electrically conductive assembly are formed in one or more conductive layers of a printed circuit board (PCB).

9. The hearing aid antenna assembly of claim 8, wherein the PCB comprises a flexible printed circuit board (FPCB).

10. The hearing aid antenna assembly of claim 1, wherein the electrically conductive assembly comprises a battery shield.

11. A hearing aid, comprising:

the hearing aid antenna assembly of claim 1, wherein the transceiver is electrically coupled to the hearing aid antenna assembly.

12. The hearing aid of claim 11, wherein the hearing aid antenna assembly is electrically coupled to the transceiver via a matching network.

13. The hearing aid of claim 12, wherein the matching network is a broadband matching network.

14. The hearing aid of claim 11, wherein the hearing aid antenna assembly is supported in a housing configured to be positioned behind an ear of the wearer.

15. The hearing aid of claim 14, wherein the hearing aid antenna assembly is oriented such that the aperture of the hearing aid antenna assembly faces parallel relative to the head of the wearer.

16. The hearing aid of claim 11, wherein the resonant loop antenna has a dipole radiation pattern in free space.

17. The hearing aid of claim 16, wherein the aperture of the resonant loop antenna is arranged along the axis of the dipole.

18. The hearing aid of claim 11, wherein the transceiver is a Bluetooth transceiver.

19. The hearing aid of claim 11, wherein the transceiver is configured to generate an audio signal based on audio data received by the hearing aid antenna assembly.

20. The hearing aid of claim 19, further comprising an acoustic transducer configured to generate audio based on the audio signal.

21. The hearing aid of claim 20, wherein the acoustic transducer is configured to be positioned within an ear canal of the wearer.

22. The hearing aid antenna assembly of claim 1, wherein the aperture comprises one or more open ends facing away from a human body of the wearer.

23. A hearing aid antenna assembly, comprising:

a resonant loop antenna, wherein a first end of the resonant loop antenna is electrically coupled to earth and a second end of the resonant loop antenna is electrically coupled to a single ended RF feed via a matching circuit;

a coupling mechanism configured to transfer RF energy between a transceiver and the resonant loop antenna; and an electrically conductive assembly; wherein the resonant loop antenna forms an aperture that is arranged to be parallel to a head of a wearer when the hearing aid antenna assembly is worn, and wherein the resonant loop antenna excites the electrically conductive assembly.

24. A hearing aid antenna assembly, comprising:

a resonant loop antenna;

a coupling mechanism configured to transfer RF energy between a transceiver and the resonant loop antenna, wherein the coupling mechanism comprises a primary loop, and wherein a first end of the primary loop is electrically coupled to the resonant loop antenna and a second end of the primary loop is electrically coupled to a single ended RF feed via a matching circuit; and an electrically conductive assembly; wherein the resonant loop antenna forms an aperture that is arranged to be substantially parallel to a head of the wearer when the hearing aid antenna assembly is worn, and wherein the resonant loop antenna excites the electrically conductive assembly.

* * * * *